US008052257B2

(12) United States Patent
Gonzales

(10) Patent No.: US 8,052,257 B2
(45) Date of Patent: Nov. 8, 2011

(54) COMBINED INK FAMILY KEYING FOR AN INK CARTRIDGE

(75) Inventor: Curt Gonzales, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1161 days.

(21) Appl. No.: 11/699,869

(22) Filed: Jan. 30, 2007

(65) Prior Publication Data

US 2008/0180495 A1 Jul. 31, 2008

(51) Int. Cl.
*B41J 2/175* (2006.01)

(52) U.S. Cl. ..... 347/86

(58) Field of Classification Search ..... 347/86
See application file for complete search history.

(56) References Cited

U.S. PATENT DOCUMENTS 6,142,617 A * 11/2000 Barinaga et al. ..... 347/85
6,273,560 B1 8/2001 Keefe et al.
6,296,345 B1 10/2001 Kline et al.
6,422,693 B2 7/2002 Pawlowski, Jr. et al.
6,435,662 B2 8/2002 Kline et al.
6,454,400 B1 * 9/2002 Morita et al. ..... 347/86
6,471,333 B1 * 10/2002 Powell et al. ..... 347/49
6,502,917 B1 1/2003 Shinada et al.
2001/0045977 A1 * 11/2001 King et al. ..... 347/86
2004/0017448 A1 1/2004 Murakami et al.
2004/0114001 A1 * 6/2004 Hayashi et al. ..... 347/86
2004/0183870 A1 * 9/2004 Steinmetz et al. ..... 347/85

FOREIGN PATENT DOCUMENTS

EP 1346834 9/2003

OTHER PUBLICATIONS

International Search Report for Application PCT/US/2008/051262. Report issued Apr. 29, 2008.

* cited by examiner

*Primary Examiner* — Laura Martin

(57) ABSTRACT

An ink cartridge includes a single insertion key having a combined datum and keying feature, said insertion key being located on a back edge portion of the ink cartridge, the insertion key being configured to provide a pivotal reference point for insertion of the ink cartridge into the carriage. The ink cartridge also includes a single insertion slot in a bottom surface of said ink cartridge, said insertion slot configured to receive an alignment post.

12 Claims, 5 Drawing Sheets

COMBINED INK FAMILY KEYING FOR AN INK CARTRIDGE

BACKGROUND

Ink jet printers operate by ejecting tiny drops of ink from a printhead onto a printing medium, such as paper. The printhead generally includes a nozzle plate having a plurality of nozzles through which tiny ink droplets are ejected onto the paper to collectively create an image. To deliver ink to the nozzles, the printhead includes a plurality of ink firing chambers, each fluidically connected to an associated nozzle through a bore. Within each firing chamber is a heat-generating resistor that is selectively energized to heat the ink in the chamber, which creates a bubble. As the bubble expands, some of the ink is forced through the bore out of the nozzle and onto the paper. Though specific printer configurations may vary, the printhead and nozzles are often incorporated into a printer carriage inside the printer. The printhead may be integrated into the carriage, or may be a removably detached insert. In any case, the ink is supplied to the printhead by a cartridge that is inserted into, and detachably mounted, within the printhead and carriage. The cartridge is fluidically and electrically connected to the printhead and carriage through fluidic and electrical interfaces. The reliability of the cartridge and printhead assembly, and ultimately the quality of the printed image, depends in part on the proper alignment and engagement of the fluidic and electrical interfaces. Rough operation during insertion or removal of the cartridge by a user, or play between the cartridge and the printhead or carriage, can cause communication loss (e.g., print command signal loss) or a loss in print quality due to a poor fluidic connection. To secure the alignment and positioning of the cartridge within the carriage, known cartridge designs have an incorporated datum feature that provides a point of reference for insertion of the ink cartridge. In this way, the cartridge is properly positioned and engaged within the carriage and/or printhead assembly to provide adequate fluidic and electrical interconnects.

In addition to datum features, known ink jet cartridges may include a keying feature to prevent the insertion of an incompatible ink cartridge. In some cases, ink cartridges are universal and can be used on a number of different printer families. Some ink cartridges, however, contain inks that may be chemically incompatible with other ink types. If incompatible inks come into contact with one another, they could congeal and damage the printhead and nozzle assembly.

Although ink jet cartridges may vary with respect to size and shape, they have historically been large enough in width and surface area to accommodate both datum and keying features. However, it has become increasingly important to design ink jet cartridges as narrow as possible because the overall width of the cartridge influences the width of the printer. With the onset of narrower ink cartridges there is no longer the width available for both the datum and keying features.

The embodiments described hereinafter were developed in light of these and other drawbacks associated with the implementation of incorporating both datum and keying features on narrow width ink jet cartridges.

BRIEF DESCRIPTION OF THE DRAWINGS

The present embodiments will now be described, by way of example, with reference to the accompanying drawings, in which.

DETAILED DESCRIPTION

An ink cartridge having combined datum and keying features is provided. The ink cartridge includes an ink supply port, an electrical interconnect, and an out-of-ink prism. The combined datum and keying feature (i.e., "the insertion key"), serves as a pivotal reference point to guide the positioning of the ink cartridge into a printer carriage. In this way, the ink supply port, the electrical interconnect, and the out-of-ink prism are properly aligned with respect to the printhead assembly and the printer carriage, which assures proper fluidic and electrical communication.

Figure 1:
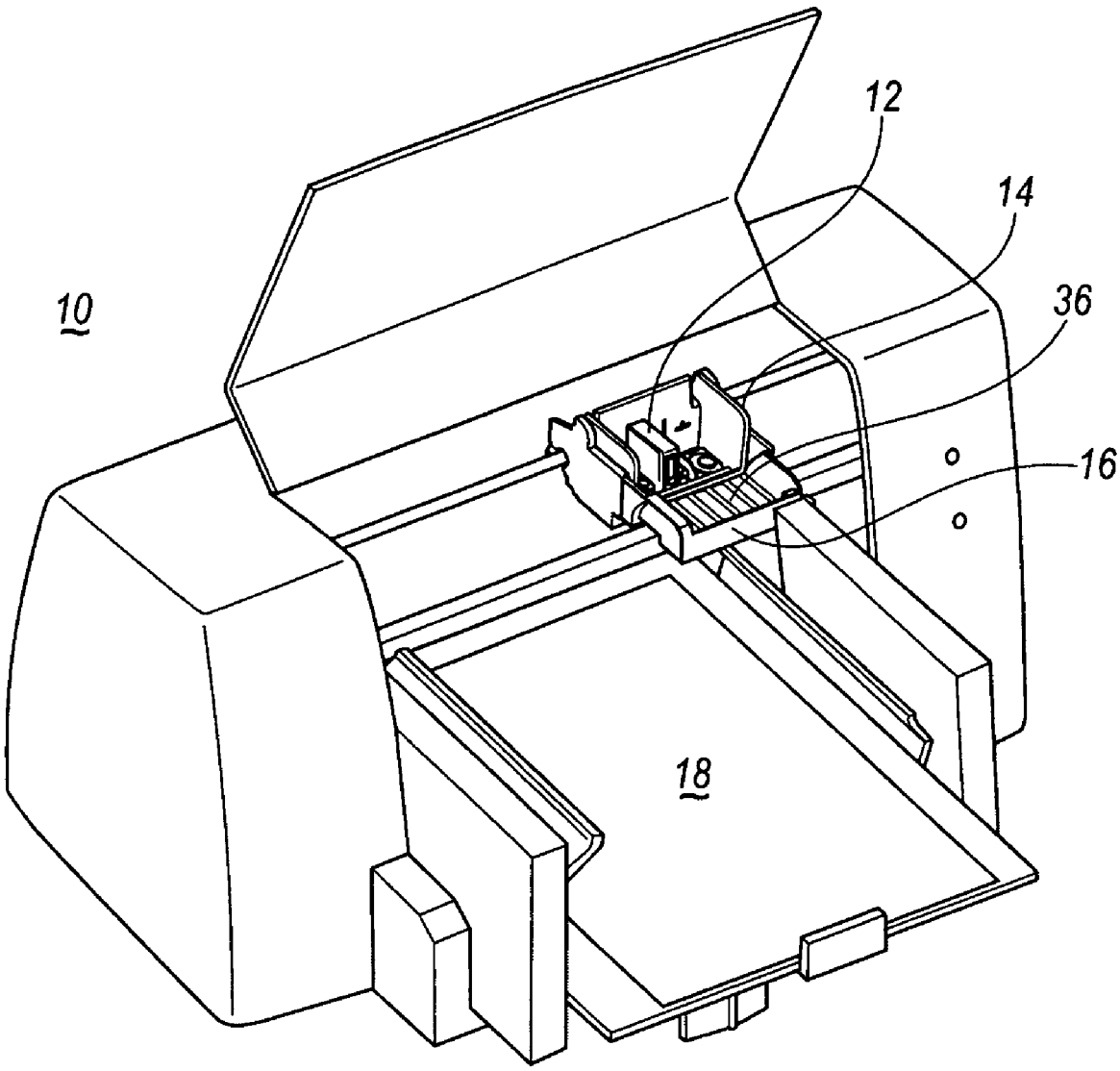
FIG. 1 illustrates an exemplary inkjet printer, according to an embodiment.

FIG. 1 illustrates an exemplary ink jet printer 10 having at least one ink cartridge 12 mounted within a printhead assembly 14 and a carriage 16. Ink droplets are ejected onto a printing medium, such as paper 18, through the printhead, which generally includes a plurality of nozzles. The printhead and nozzles can be incorporated into the carriage 16, integrated into the ink cartridge 12, or as shown in FIG. 1, be a removable insert 14 positioned within the carriage 16. In any case, the ink cartridge 12 supplies ink to the printhead assembly 14, which selectively ejects drops of ink onto the paper 18 as the carriage 16 traverses back and forth from one side of the printer 10 to the other in a bi-directional fashion.

Figure 2:
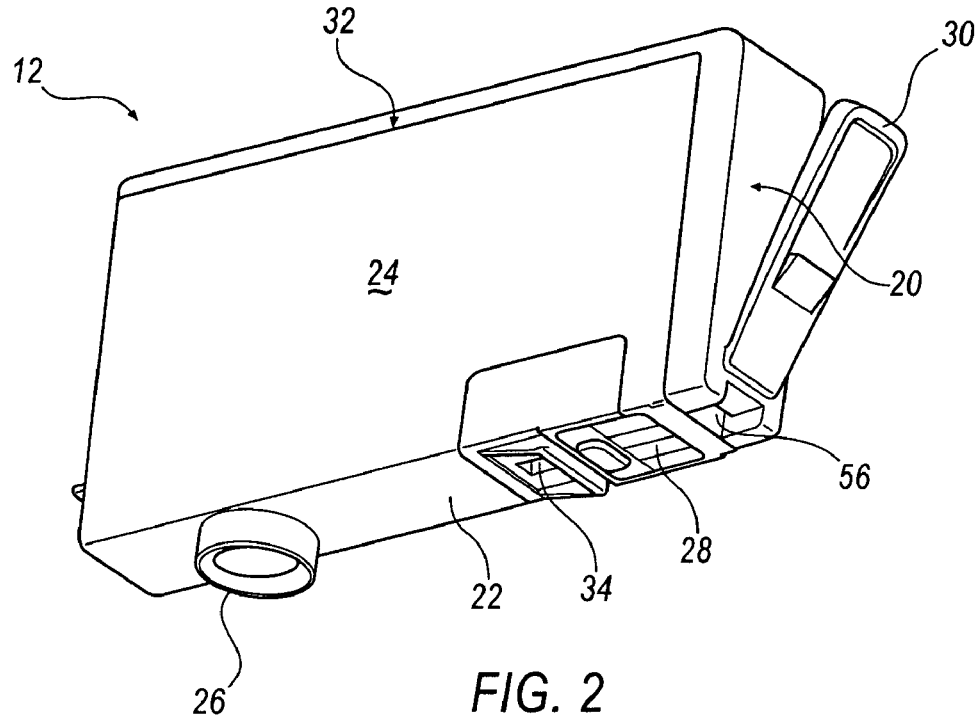
FIG. 2 illustrates an exemplary isometric view of an ink cartridge, according to an embodiment.

FIG. 2 illustrates an exemplary isometric view of an ink cartridge 12 showing a front edge portion 20, a bottom surface 22 and a first side 24. The ink cartridge 12 includes an ink supply port 26, an electrical interconnect 28 and a retaining latch 30 for securing the ink cartridge 12 into the carriage 16 upon insertion. In one embodiment, the retaining latch 30 extends across at least the front edge portion 20 of ink cartridge 12. In another embodiment, as shown in FIG. 2, the retaining latch 30 is a one-piece molded structure that covers the length of the front edge portion 20 and extends across a top surface 32. The ink supply port 26 and the electrical interconnect 28 are located on bottom surface 22 and engagingly connect to reciprocal receptacles (not shown) located in the printhead 14 and carriage 16, respectively. When engaged, the ink supply port 26 and the electrical interconnect 28 provide fluidic and electrical connectivity between the ink cartridge 12 and the printhead 14 and carriage 16.

The bottom surface 22 of cartridge 12 further includes an out-of-ink prism 34 that works in combination with an optical sensor 36 (shown in FIGS. 1 and 6) in carriage 16 to sense when the ink cartridge 12 is out of ink. Specifically, the optical sensor 36 includes an emitter and a detector, wherein the emitter emits lights into one side of the prism. If there is ink present in the cartridge 12, the emitted light is diffused by the ink and scatters into the cartridge 12 preventing light from reflecting back to the detector. If no ink is present in the cartridge 12, the emitted light is reflected back to the detector indicating that the cartridge 12 is empty. In one embodiment, the out-of-ink prism 34 also includes a clear window that enables a user to view the amount of ink inside cartridge 12.

Figure 3:
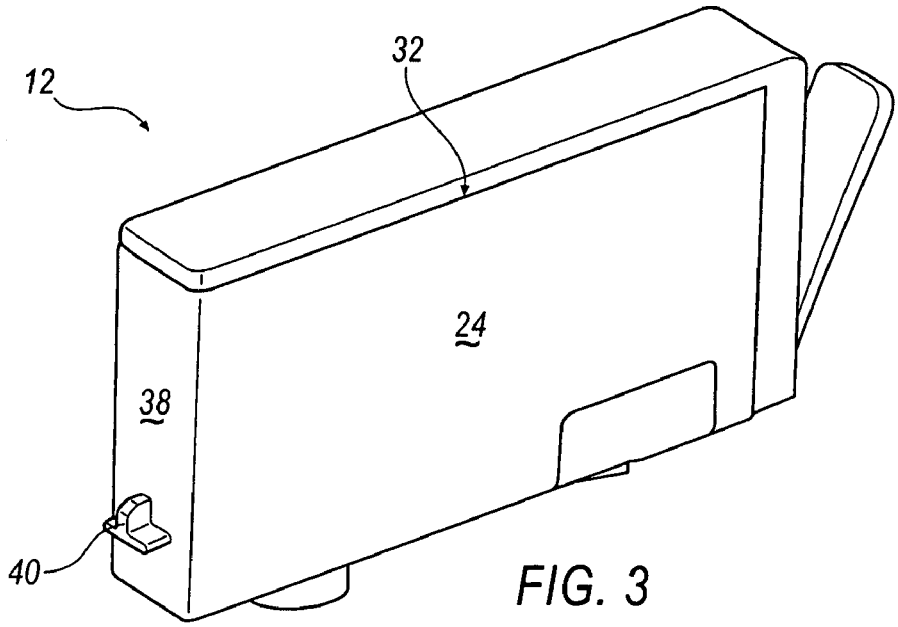
FIG. 3 illustrates another exemplary isometric view of an ink cartridge, according to an embodiment.
Figure 4:
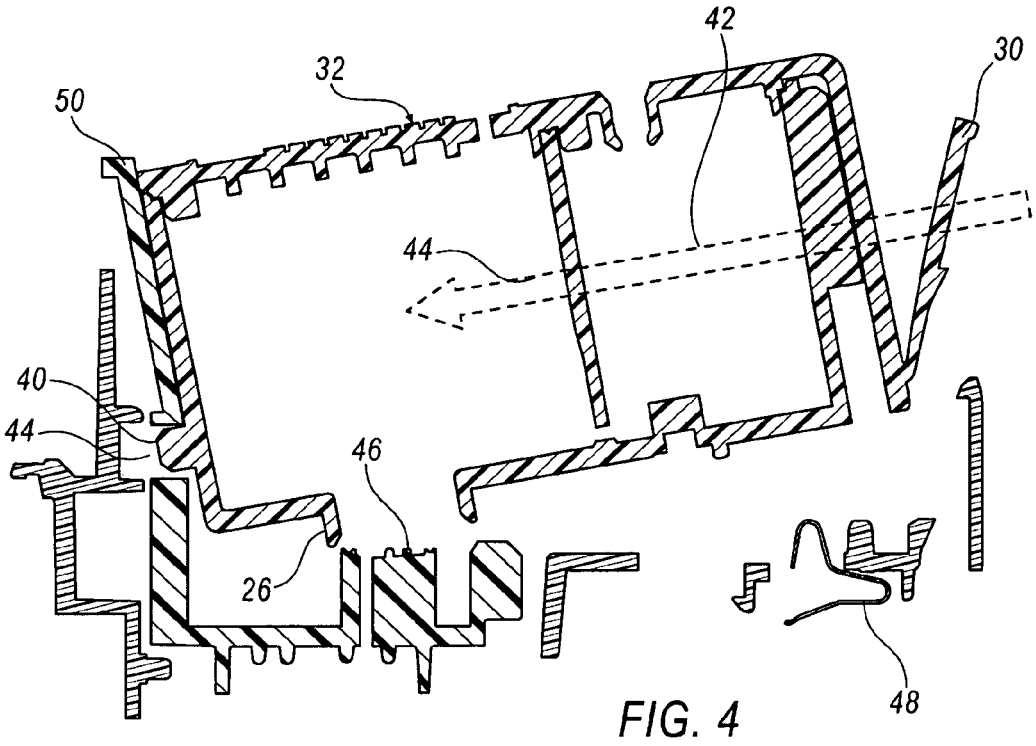
FIG. 4 illustrates the partial insertion of an exemplary ink cartridge into a printhead and carriage assembly, according to an embodiment.
Figure 5:
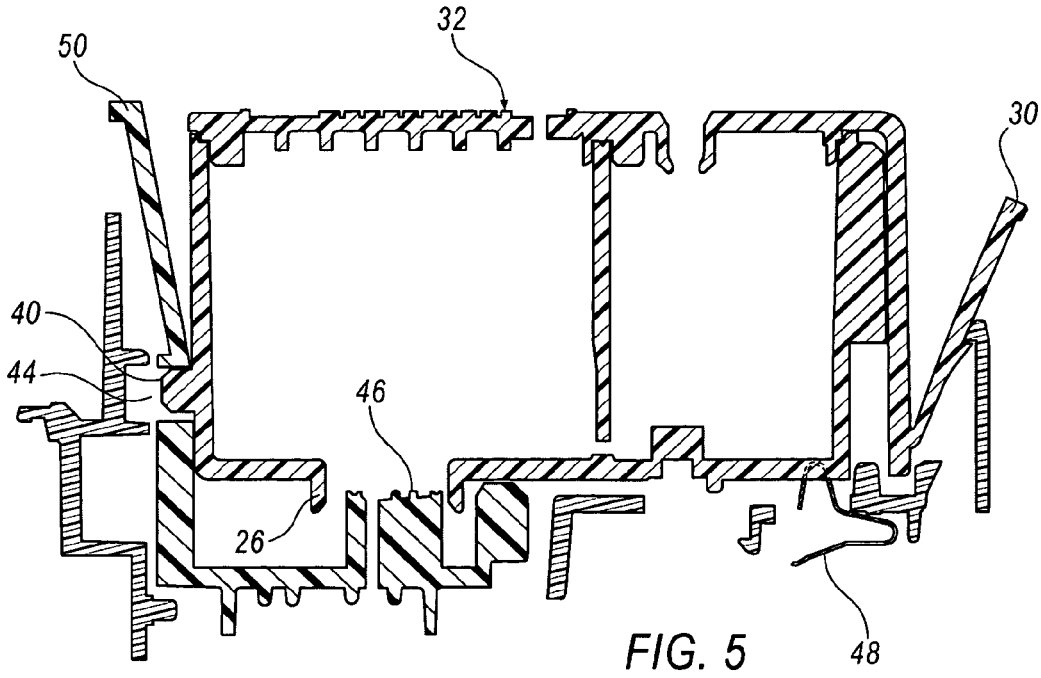
FIG. 5 illustrates an exemplary ink cartridge fully inserted into a printhead and carriage assembly, according to an embodiment.

FIG. 3 illustrates another exemplary isometric view of ink cartridge 12, including top surface 32 and a back edge portion 38. The back edge portion 38 includes an insertion key 40 that provides a pivotal reference point for insertion of the cartridge 12 into carriage 16. The insertion of cartridge 12 into the printhead 14 and carriage 16 assembly is generally shown in FIGS. 4 and 5, wherein FIG. 4 illustrates the partial insertion of the cartridge 12 and FIG. 5 illustrates the cartridge 12 being fully seated. Arrow 42 indicates the insertion path of ink cartridge 12 being inserted into the printhead 14 and carriage 16 assemblies, where the insertion key 40 engages a key receptacle 44 and provides a pivotal reference point. Ink cartridge 12 is then pivoted downward to engage the retaining latch 30 into the fully seated position shown in FIG. 5. The insertion key 40 assures proper alignment of ink cartridge 12 into the printhead 14 and carriage 16 assemblies enabling proper fluidic and electrical interconnects. For example, when properly positioned and fully seated, ink supply port 26 is fluidically connected to a fluidic interconnect 46, which is located on printhead 14. Similarly, in a fully seated position, electrical interconnect 28 is electrically connected to an electrical interconnect 48, which is located on carriage 16.

Figure 6:
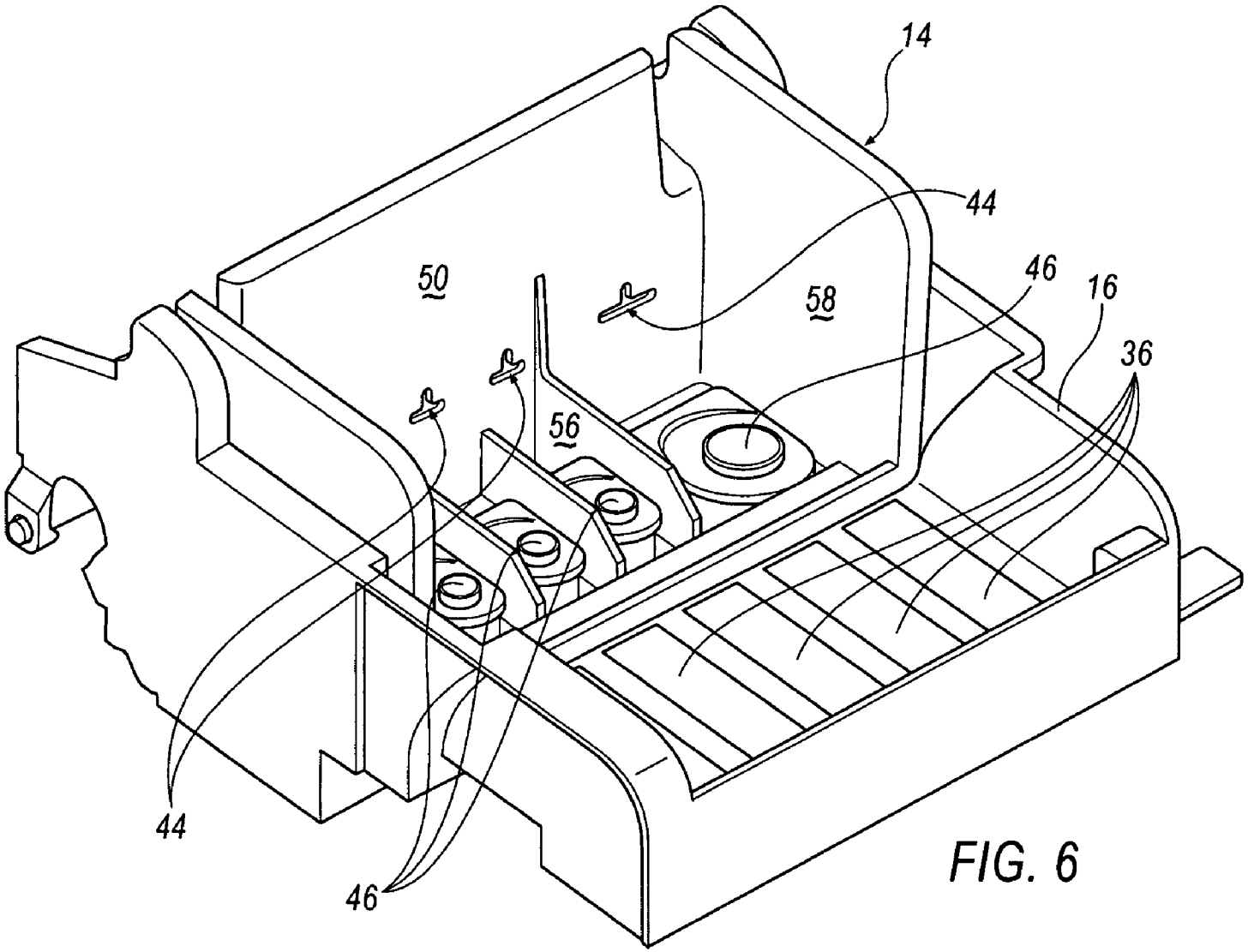
FIG. 6 illustrates an isometric view of a carriage and printhead assembly, according to an embodiment.

In addition to guiding the movement of cartridge 12 into the printhead 14 and carriage 16 assemblies, insertion key 40 also provides a keying feature to prevent the installation of an incorrect ink cartridge into carriage 16. In other words, insertion key 40 is configured such that ink cartridge 12 can only be inserted and properly seated into the printhead 14 and carriage 16 assemblies if there exists a receptacle having a matching reciprocal configuration. FIG. 6 illustrates an exemplary printhead 14 and carriage 16 configurations wherein the printhead assembly 14 is inserted into carriage 16. The insertion key 40 as shown in FIG. 3 has an inverted T-shape configuration that matches key receptacle 44 located on a back surface 50 of carriage 16, as shown in FIG. 6. One of ordinary skill in the art understands that the specific configuration of the insertion key 40 and the matching key receptacle 44 may vary and that the inverted T-shape configuration of insertion key 40 as shown in FIG. 6 is exemplary. For example, in an alternative embodiment, the insertion key 40 and the matching key receptacle on the carriage 16 may be in an L-shaped configuration.

Figure 7:
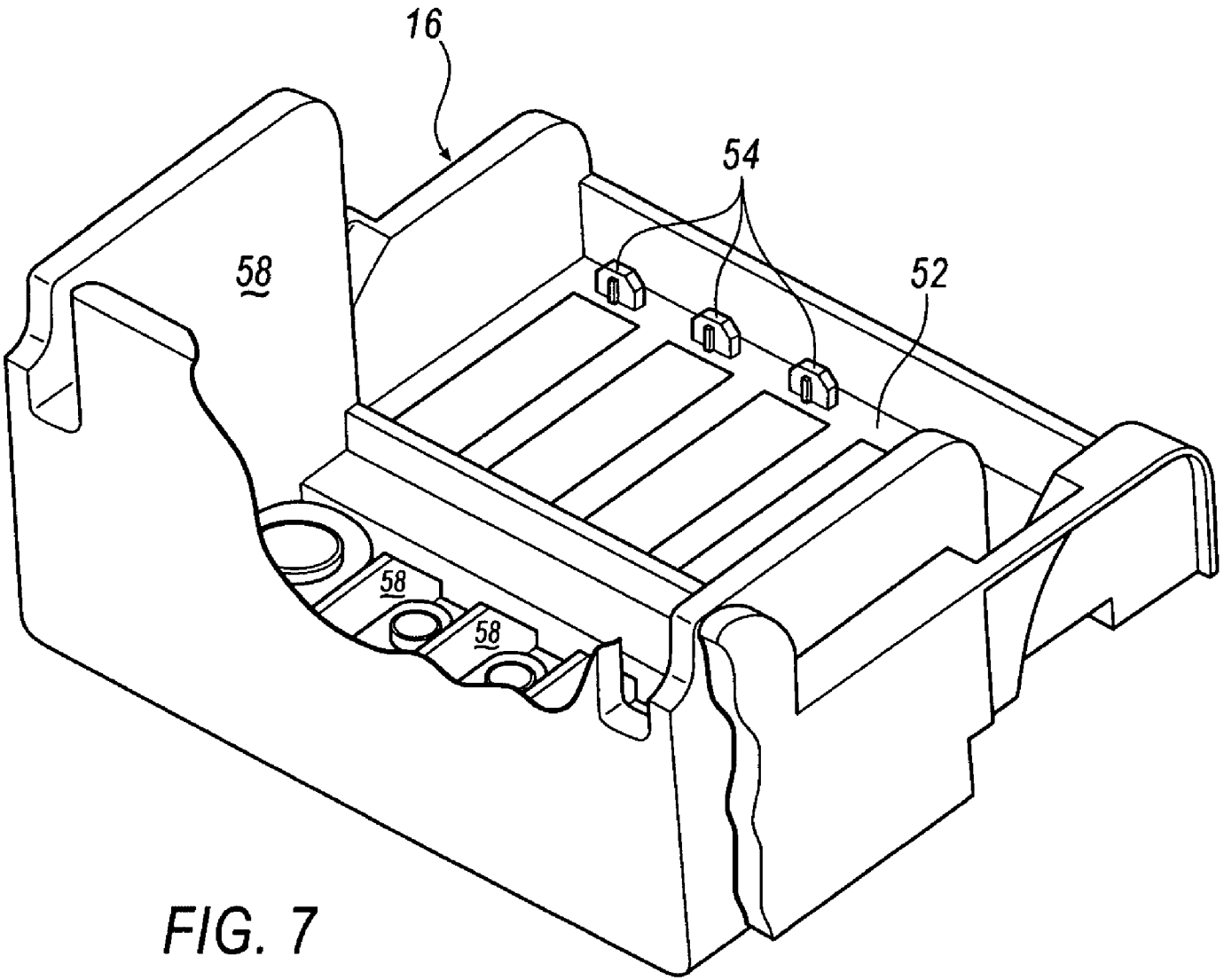
FIG. 7 illustrates an isometric view of a carriage having an alignment post, according to an embodiment.

FIG. 7 illustrates an isometric view of an exemplary carriage 16 wherein a front end surface 52 of carriage 16 includes an alignment post 54. The alignment post 54 is used in conjunction with an insertion slot 56 on ink cartridge 12 (shown in FIG. 2) to further guide the insertion of ink cartridge 12 into carriage 16. Alignment post 54 is particularly advantageous in printer configurations in which the width of the carriage is greater than the width of the of the ink cartridge 12. The outward projection of alignment post 54 engages with insertion slot 56 to position and secure ink cartridge 12 into carriage 16, irrespective of printhead side walls 58 (shown in FIGS. 6 and 7).

While the present invention has been particularly shown and described with reference to the foregoing preferred embodiments, it should be understood by those skilled in the art that various alternatives to the embodiments of the invention described herein may be employed in practicing the invention without departing from the spirit and scope of the invention as defined in the following claims. It is intended that the following claims define the scope of the invention and that the method and system within the scope of these claims and their equivalents be covered thereby. This description of the invention should be understood to include all novel and nonobvious combinations of elements described herein, and claims may be presented in this or a later application to any novel and nonobvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. An ink cartridge, comprising:

a single insertion key having a combined datum and keying feature, said insertion key being located on a back edge portion of the ink cartridge, wherein said insertion key provides a pivotal point around which said ink cartridge pivots for insertion of the ink cartridge into a carriage assembly; and wherein said insertion key is sized and positioned to serve as a datum indicating proper installation of said ink cartridge in said carriage assembly;

wherein said insertion key has both a specific shape and location that matches a shape and location of a corresponding key receptacle of said carriage assembly such that said ink cartridge is not completely received in said carriage assembly unless said insertion key matches said corresponding key receptacle.

2. The ink cartridge of claim 1, further comprising a single insertion slot in a bottom surface of said ink cartridge, said insertion slot configured to receive an alignment post, wherein said carriage assembly includes a printhead assembly and said alignment post.

3. The ink cartridge of claim 2, further comprising a supply port on the ink cartridge to fluidically connect the ink cartridge with a corresponding fluidic interconnect of said printhead assembly.

4. The ink cartridge of claim 2, further comprising:

an ink supply port configured to be fluidically connected to said printhead assembly; and an electrical interconnect configured to establish electrical connectivity between the ink cartridge and said carriage assembly;

wherein a datum feature of said insertion key selectively positions said ink supply port and said electrical interconnect such that said ink supply port establishes a fluidic interconnect between the ink cartridge and said printhead assembly, and said electrical interconnect establishes electrical connectivity between the ink cartridge and said carriage assembly.

5. The ink cartridge of claim 2, wherein said insertion key is configured to be received by a key receptacle located in said printhead assembly.

6. The ink cartridge of claim 1, further comprising an electrical interconnect, wherein said carriage assembly includes a first electrical interconnect for establishing electrical connectivity between said carriage assembly and said electrical interconnect on the ink cartridge.

7. The ink cartridge of claim 1, wherein said insertion key and said key receptacle are configured in reciprocal inverted T-shape configurations.

8. The ink cartridge of claim 1, wherein said insertion key and said key receptacle are configured in reciprocal L-shape configurations.

9. The ink cartridge of claim 1, further comprising a one-piece retaining latch extending along a front edge portion and a top surface of the ink cartridge.

10. The ink cartridge of claim 1, further comprising an out-of-ink prism for detecting an out of ink condition in the ink cartridge.

11. The ink cartridge of claim 10, wherein said out-of-ink prism includes a window that enables a user to view the quantity of ink contained within the ink cartridge.

12. The ink cartridge of claim 1, further comprising an insertion slot in a bottom surface of said ink cartridge that is located on a front edge portion of said ink cartridge, wherein said insertion slot is configured to receive an alignment post located in said carriage to secure said ink cartridge into said carriage, irrespective of any carriage side walls.

* * * * *